United States Patent [19]

Fardeau et al.

[11] Patent Number: 4,583,938

[45] Date of Patent: Apr. 22, 1986

[54] GAS BURNER OF THE PRE-MIXTURE TYPE WITH FLAME CONTROL AND UTILIZATION OF THAT BURNER ESPECIALLY IN AN IMMERSED PIPE INSTALLATION

[75] Inventors: Benoît H. Fardeau, Pierrefitte; Claude Chapuis, Epinay sur Seine; Georges Austruy, Villetaneuse, all of France

[73] Assignee: Gaz de France, Paris, France

[21] Appl. No.: 617,457

[22] Filed: Jun. 5, 1984

[30] Foreign Application Priority Data

Jun. 8, 1983 [FR] France ..... 83 09468

[51] Int. Cl.[4] ..... F23N 5/08

[52] U.S. Cl. ..... 431/79; 431/173; 431/329

[58] Field of Search ..... 431/79, 173, 190, 181, 431/264, 265, 266, 329, 328, 354; 340/578

[56] References Cited

U.S. PATENT DOCUMENTS

| | | | |
|---|---|---|---|
| 2,395,103 | 2/1946 | Clausen et al. | 431/173 |
| 2,772,645 | 12/1956 | Hardgrove | 431/173 |
| 2,843,197 | 7/1958 | Snyder | 431/329 X |
| 3,280,882 | 10/1966 | Hemker | 431/79 |
| 3,486,835 | 12/1969 | Grobe | 431/79 |
| 3,825,913 | 7/1974 | Metcalf et al. | 431/79 X |

FOREIGN PATENT DOCUMENTS

| | | | |
|---|---|---|---|
| 2621496 | 12/1976 | Fed. Rep. of Germany | 431/173 |
| 1004670 | 4/1952 | France | 431/173 |
| 1257092 | 2/1961 | France . | |
| 2063803 | 7/1971 | France . | |
| 2274869 | 1/1976 | France . | |
| 491714 | 9/1938 | United Kingdom | 431/79 |
| 613883 | 12/1948 | United Kingdom . | |

OTHER PUBLICATIONS

M. Fardeau, "Nouveaux Echangeurs Alimentes au Gaz Naturel pour le Chauffage des Bains Industriels," Revue Generale de Thermique, vol. 22, No. 253, Jan. 1983, pp. 27–45.

*Primary Examiner*—Randall L. Green

*Attorney, Agent, or Firm*—Pollock, VandeSande & Priddy

[57] ABSTRACT

A gas burner of the air and combustible gas mixture type includes a flame control cell mounted away from the actual flame. The control cell, by being located away from the actual flame, can monitor the operating conditions of the flame and, in response thereto, controls the flow of air and gas, the firing of the lighting electrode and the regulating of the gas intake valve. The control cell is further protected from the flame and any possible backfires by a pressure differential existing between the injected air and combustible gas mixture.

4 Claims, 2 Drawing Figures

GAS BURNER OF THE PRE-MIXTURE TYPE WITH FLAME CONTROL AND UTILIZATION OF THAT BURNER ESPECIALLY IN AN IMMERSED PIPE INSTALLATION

FIELD OF THE INVENTION

This invention pertains to improvements on a pre-mix type of gas burner with flame control.

BRIEF DESCRIPTION OF THE PRIOR ART

This type of burner is commonly used by industry, which permits especially high heating levels per area unit.

More specifically, the pre-mix type of gas burner with flame control according to the invention is of the type which includes an intake of air plus a combustible gas pre-mixture in a distribution chamber that leads through a flame stabilizing grid into a combustion chamber. Various projects have been conducted o this type of burner, and we can especially mention French Pat. No. 2,063,803 dated Oct. 31, 1969 which was filed in the name of the same applicant for a "high heating level gas burner". However, in the patent, we basically aimed at particular industrial applications like the welding of large diameter pipes, treating sheets, etc. On the other hand, the invention pertains in a more specific way to the area of immersed pipe heating, which raises particular questions especially as regards flame stabilization resulting from strong changes in pressure generated by the combustion of a high powered flame in a compact environment. Furthermore, we must ensure continuous and effective monitoring of the flame especially in order to prevent any sudden extinguishing of the burner during combustion. The result is particularly harsh operating conditions for the flame control cell when it must function in an immersed environment, while being subjected to very high thermal constraints.

The invention is designed to resolve the above mentioned difficulties.

SUMMARY OF THE INVENTION

To this end, according to the invention, in order to facilitate flame control by releasing the control cell from thermal constraints connected to the operation of the burner, said cell is located to the rear of said distribution chamber behind said flame stabilizing grid, in relation to the flow direction of the combustible mixture. This permits the control cell to "read" the operating conditions of the flame through said grid. Hence, the control cell is actually protected by the distribution grid and by the distribution chamber, which is intermediate of the cell and said grid. Furthermore, this arrangement readily makes it possible to place the control cell outside of the bath to be heated were the burner required to be outfitted to an immersed pipe.

Advantageously, the cell is located to the rear of a nozzle of which the axis is directed more or less perpendicular to said flame stabilizing grid, said nozzle communicating through an orifice in said distribution chamber, and a secondary air intake under pressure which leads into said nozzle. Thus, additional cooling is ensured in the vicinity of said reading cell which is therefore effectively removed from burner operating thermal constraints.

According to another characteristic of the invention, a lighting electrode is mounted through said distribution chamber which leads with its conveniently electrically insulated electrode through said stabilizing grid and with its head connected to the electric supply at the rear of said distribution chamber.

The invention also applies to the use of burners which are adapted to a combustion chamber.

BRIEF DESCRIPTION OF THE DRAWINGS

The invention, its characteristics and advantages shall be more clear with the description which follows in reference to the attached drawings wherein.

DETAILED DESCRIPTION OF THE INVENTION

Figure 1:
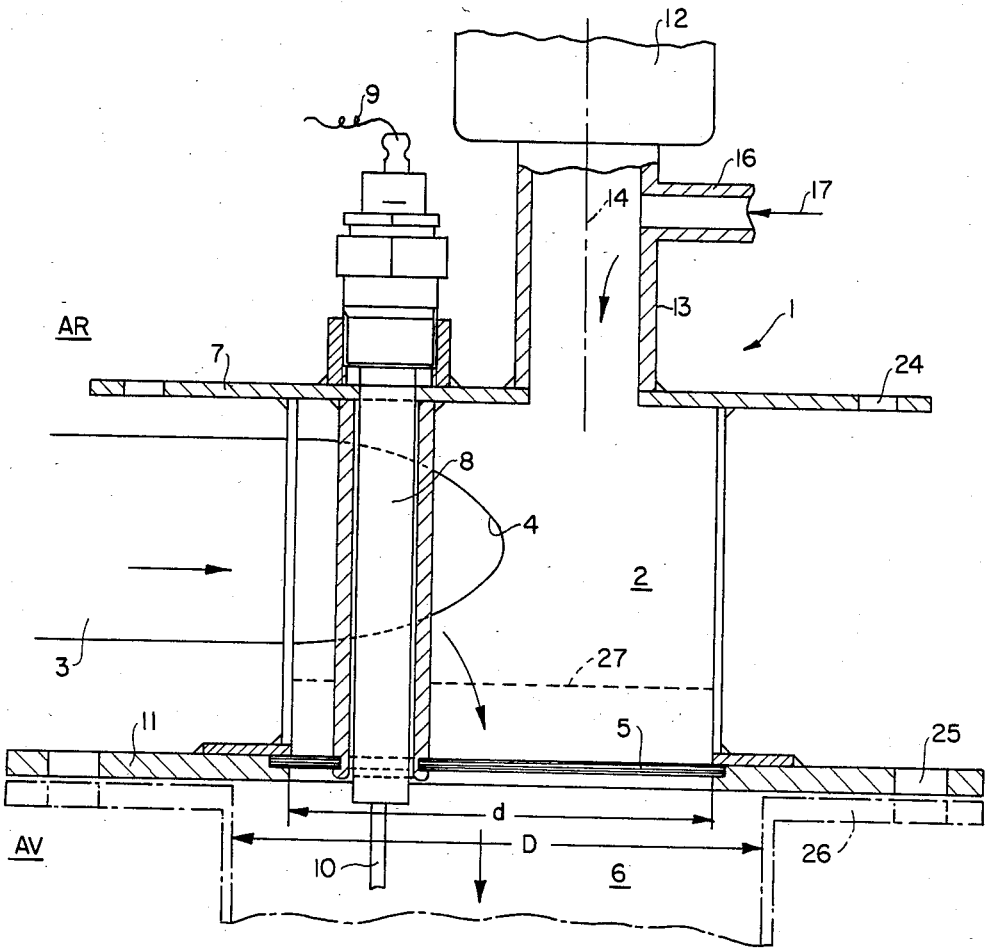
FIG. 1 schematically displays partly as a section, and partly in an external view with bursts, a gas burner in conformance with the invention, FIG. 2 displays an example of the burner assembly of FIG. 1 being used in conjunction with an immersed pipe.

First, by referring to FIG. 1, the burner as a unit referred to as 1 basically includes a distribution chamber 2 in which the combustible air/gas pre-mixture arrives through a supply duct 3 which advantageously leads into the chamber through a fairly tangential opening 4. The chamber 2 which is usually shaped like a cylindrical caisson with a fairly circular section is obstructed at its forward side by a flame stabilizing grid 5. This grid can be of the kind which is described in the above mentioned French Pat. No. 2,063,803, that basically includes orifices with adequate diameters and distribution in order to ensure proper catching and proper stabilizing of flames at the input of the combustion chamber 6 at considered burner operating levels.

At its rear side the caisson which acts as the distribution chamber is closed by a wall 7. In the figure we indicated with the letters AV and AR respectively the "forward" and "rear" side of the burner by referring to the circulation of the combustible mixture inside the burner as diagrammed by the arrows.

In the illustrated example lightly the burner is ensured by an electrode 8 which is supplied under proper high voltage as diagrammed at 9 and properly insulated, lightly occuring with sparks between the point 10 of the lighting electrode and the neighboring wall of the front metallic flask 11 which is appropriately placed onto the mass of the caisson that acts as the distribution chamber 2.

In order to monitor the sound operation of the burner, we placed behind the rear wall 7 of the chamber 2 a flame control cell 12 which is sensitive to ultra-violet radiation of the flame, by "reading" the information through the orifices of the flame stabilizing grid 5. In the illustrated assembly the cell 12 is located to the rear of a nozzle 13 of which the axis 14 is directed more or less perpendicular to the flame stabilizing grid 5, said nozzle communicating through an orifice inside the distribution chamber 2.

At 16 we also see as it leads through the rear of the nozzle 13 a secondary duct which brings in air under pressure as indicated by arrow 17, this secondary air circulation ensuring additional cooling between the distribution chamber 2 and the cell 12.

Figure 2:
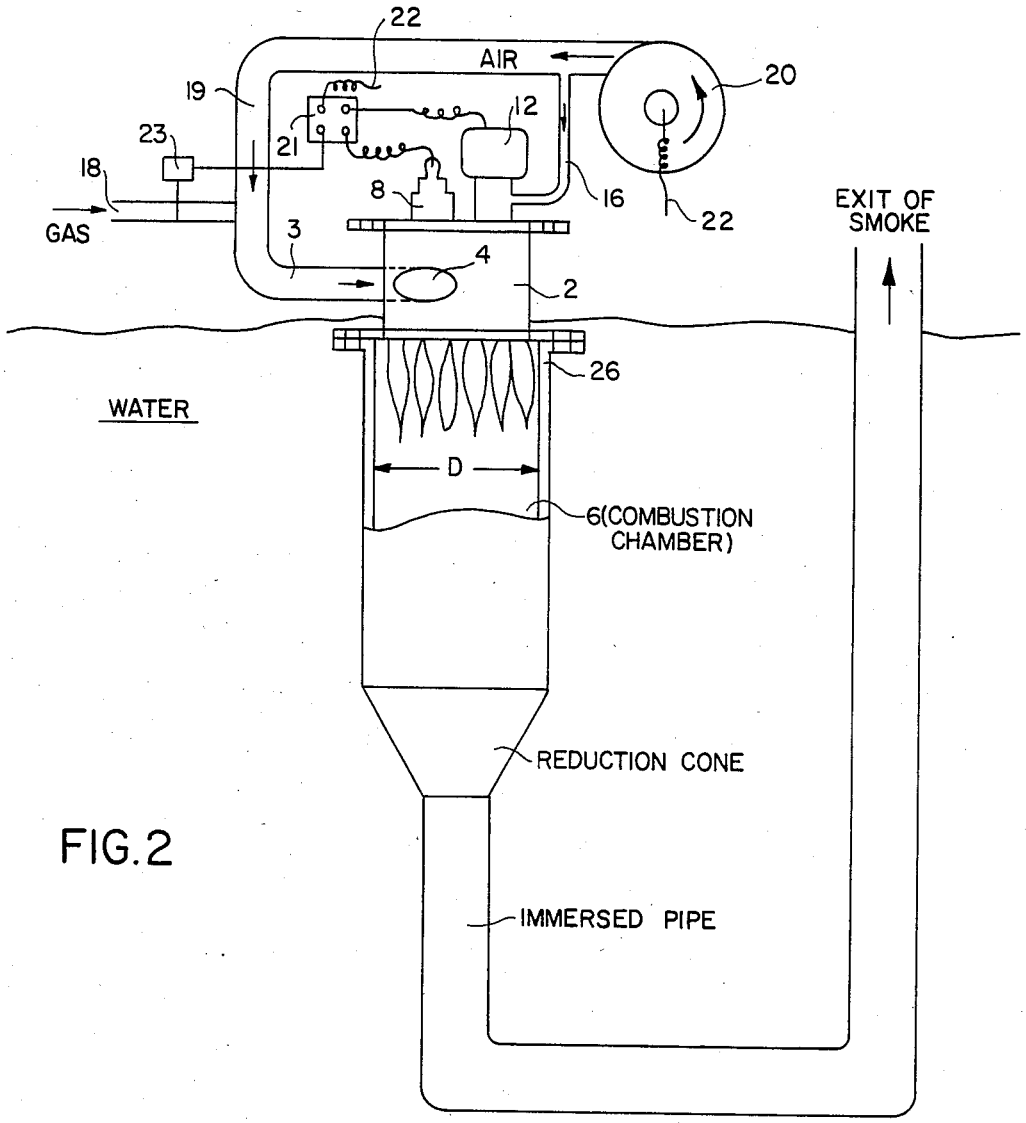

By referring to FIG. 2, we see that the burner is supplied with combustible gas through a duct 18 and with main air through a duct 19, the pre-mixture thus being released to the duct 3 under fairly stoichiometric conditions. The air is released with a fan or a compressor 20 that not only supplies the main air duct 19 but also the secondary air duct 16, the branchings being performed so that the secondary air intake pressure inside the nozzle 13 shall be greater than that of the intake of the premixture inside the distribution chamber 2, so as to obtain the sweep and cooling of the nozzle 13 with the depletion of secondary air coming in by 17 as desired.

In a conventional way which will not be described, the cell 12 is connected to the operating programmer 21 of the burner which controls through proper branchings the lighting electrode 8, the fan 20 and the regulated gas intake valve 23.

In FIG. 1 again, we note on the rear flask 7 orifices 24 which enable the assembly of the burner onto the static frame of the heating generator (not displayed). On the front flask 11 we note orifices 25 which enable the adjustment onto the bridge 11 of the flask 26 that acts as the input of the combustion chamber 6 which can therefore be easily affixed under the burner. Also, we note that the diameter D of the combustion chamber 6 is clearly greater than the diameter d of the flame stabilizing grid 5. This arrangement which is permitted by the particular high power allowed by the burner makes it possible, as opposed to what is done in conventional immersed pipe installations, to avoid having to make the burner penetrate fairly deeply inside the combustion chamber, with all the disadvantages which it implies at the implant level. The burner which was described above makes it especially possible to outfit immersed pipe installations which are relatively compact in build, the immersed combustion chamber can be comprised of a simpe short pipe.

Several variations can be applied to the illustrated and described implementation mode.

Hence, we can probably equip the distribution chamber with additional homogenizing grids for proper distribution of the pre-mixture, as shown at 27 for instance.

Even though the utilization of a lighting electrode is usually preferred, we can probably also use a torch or an ancillary burner to light the burner which can be placed for instance in the axis of the burner or on the combustion chamber proper upon which the burner is affixed.

We claim:

1. A gas burner of the air and combustible gas mixture type having a combustion chamber and a distribution chamber including forward and rear open ends, the forward open end of the distribution chamber being coupled to an opening of the combustion chamber, the burner comprising:

a supply duct connected into the distribution chamber for introducing the air and combustible gas mixture thereto in a tangential flow;

a fuel control valve for regulating the combustible gas from a fuel source to said supply duct;

a flame stabilizing grid interposed between the combustion chamber opening and the forward open end of the distribution chamber for allowing the air combustible gas mixture to flow from the distribution chamber into the combustion chamber and for containig flame produced from the combustion of the air and combustible gas mixture in the combustion chamber;

ignition means extending into the combustion chamber for igniting the air and combustible gas mixture, thereby producing the flame;

a nozzle having an inlet and an outlet coupled, via its outlet, to the rear open end of the distribution chamber; the nozzle further being oriented, along its longitudinal axis, perpendicularly to the flame-stabilizing grid;

a control cell mounted on the inlet of the nozzle for sensing operating conditions of the flame, the operating condition resulting from ultraviolet radiation emitted from the flame, through the flame-stabilizing grid, said control cell causing the closing of said fuel control valve upon the sensed ultraviolet radiation of the flame falling below a desired value; and a secondary duct connected to the side of the nozzle and perpendicular to the longitudinal axis thereof for injecting pressurized air therein, the pressure of the pressurized air from the secondary duct being greater than the pressure of the air and combustible gas mixture from the supply duct so that the pressure of the air in the nozzle is greater than the pressure of the air and combustible gas mixture in the distribution chamber, the higher pressured air in the nozzle protecting the control cell from backfire and maintaining the control cell in a lower temperature environment.

2. A gas burner according to claim 1, wherein the ignition means comprises a lighting electrode assembled through the distribution chamber with an electrically insulated electrode head extending through the flame-stabilizing grid into the combustion chamber.

3. A gas burner according to claim 1, wherein the flame stabilizing grid is mounted inside a flask which closes the distribution chamber at its forward open end, the flask being adapted to fit an assembly of the combustion chamber, the flame-stabilizing grid having a diameter substantially smaller than the diameter of the assembly flask opening.

4. A gas burner according to claim 1, further being adapted to a combustion chamber and compact immersed pipe unit.

* * * * *